US010077614B2

(12) United States Patent
Telfer

(10) Patent No.: US 10,077,614 B2
(45) Date of Patent: Sep. 18, 2018

(54) DRILLING ASSEMBLY

(71) Applicant: M-I Drilling Fluids UK Ltd., Westhill (GB)

(72) Inventor: George Telfer, Aberdeen (GB)

(73) Assignee: M-I Drilling Fluids U.K. Ltd., Aberdeen (GB)

( * ) Notice: Subject to any disclaimer, the term of this patent is extended or adjusted under 35 U.S.C. 154(b) by 229 days.

(21) Appl. No.: 14/423,192

(22) PCT Filed: Aug. 23, 2013

(86) PCT No.: PCT/US2013/056448
§ 371 (c)(1),
(2) Date: Feb. 23, 2015

(87) PCT Pub. No.: WO2014/031993
PCT Pub. Date: Feb. 27, 2014

(65) Prior Publication Data

US 2015/0226017 A1 Aug. 13, 2015

Related U.S. Application Data

(60) Provisional application No. 61/692,579, filed on Aug. 23, 2012.

(51) Int. Cl.

| | |
|---|---|
| ***E21B 17/046*** | (2006.01) |
| ***E21B 7/28*** | (2006.01) |
| ***E21B 34/16*** | (2006.01) |
| ***E21B 29/00*** | (2006.01) |
| ***E21B 17/18*** | (2006.01) |
| ***E21B 37/00*** | (2006.01) |
| ***E21B 34/00*** | (2006.01) |

(52) U.S. Cl.
CPC ..... *E21B 17/046* (2013.01); *E21B 7/28* (2013.01); *E21B 17/18* (2013.01); *E21B 29/002* (2013.01); *E21B 34/16* (2013.01); *E21B 37/00* (2013.01); *E21B 2034/002* (2013.01)

(58) Field of Classification Search
CPC . E21B 7/28; E21B 10/62; E21B 17/06; E21B 23/04; E21B 29/002
See application file for complete search history.

(56) References Cited

U.S. PATENT DOCUMENTS

| | | | | |
|---|---|---|---|---|
| 4,399,873 | A | 8/1983 | Lindsey, Jr. | |
| 4,494,072 | A * | 1/1985 | Jeter | E21B 17/003 175/321 |
| 5,181,569 | A * | 1/1993 | McCoy | E21B 34/14 166/135 |
| 6,530,429 | B2 | 3/2003 | Howlett | |
| 7,096,950 | B2 | 8/2006 | Howlett et al. | |
| 7,237,617 | B2 | 7/2007 | Howlett | |
| 7,703,553 | B2 | 4/2010 | Eddison et al. | |

(Continued)

*Primary Examiner* — David J Bagnell
*Assistant Examiner* — Jonathan Malikasim
(74) *Attorney, Agent, or Firm* — David J. Smith

(57) ABSTRACT

A tool assembly is described. In embodiments, the tool assembly has an elongated body having uphole and downhole ends adapted for forming a tool joint, where the body has an axial through bore and at least one aperture in a side wall of the elongated body for receiving a keying element, and an inner de-coupling sleeve movable within the through bore of the elongated body.

19 Claims, 4 Drawing Sheets

(56) References Cited

U.S. PATENT DOCUMENTS

| | | | | |
|---|---|---|---|---|
| 2004/0045714 | A1* | 3/2004 | McGavern, III ..... | E21B 29/002 166/298 |
| 2005/0045338 | A1 | 3/2005 | Howlett | |
| 2011/0186355 | A1 | 8/2011 | Telfer | |

* cited by examiner

DRILLING ASSEMBLY

BACKGROUND

In the drilling and production of oil and gas wells, it is typical practice to use a retrievable string equipped with a bottom hole assembly (BHA) including a drill bit to remove formation ahead of the drill bit and thus form a wellbore. The drill string has an axial through bore which provides a fluid path through the drill string and BHA. Circulation of drilling fluid is achievable by return through the annulus between the drill string and the wellbore. Periodically, the drill string is removed from the wellbore and a wellbore casing string comprising lengths of tubular casing sections coupled together end-to-end is positioned in the drilled wellbore and cemented in place in order to stabilize the wellbore before extending the wellbore farther. A smaller dimension drill bit is then inserted through the cased wellbore, to drill through the formation below the cased portion, to thereby extend the depth of the wellbore. A smaller diameter casing is then installed in the extended portion of the wellbore and also cemented in place. These casing operations may be concluded by running in a liner.

A liner is a narrower bore section or string of casing quality tubular that is used to case an open hole below a previously set casing string. The liner extends from the bottom of the open hole and overlaps into the previously set casing string. The overlap ranges from 100 feet to 500 feet. Liners are usually suspended from the previously set casing string by means of a liner hanger/packer assembly. As with the previously set casing, the liner tubular string is cemented in place to create a bond between the tubular and the drilled wellbore surface in the formation. In cementing the liner, the cement slurry is pumped down to the liner, followed by a displacement fluid that forces the cement out into the annulus between the borehole wall and the liner, and into the overlap between the liner and the previously set casing string. As a consequence, there remains a cement "plug" in the lower casing above the top of the liner at least, and cement is within or around the polished bore receptacle at the top of the liner.

Any subsequent wellbore operation to complete the well will require further drilling operations to drill the cement to re-open the through bore. In doing so, at least two different sized drill bits are required to complete the well, which requires sequential run in and pull out of the drill string to make the change over.

Since a round trip, i.e. run in and subsequent pull out, can take in excess of 24 hours, the current procedure represents a significant usage of offshore rig time, which at costs of the order of US$1 million per day in a typical deep offshore well location represents a considerable financial commitment.

The disclosure will now be described by way of illustrative example with reference to the accompanying drawings.

DETAILED DESCRIPTION OF THE DISCLOSURE

Figure 1:
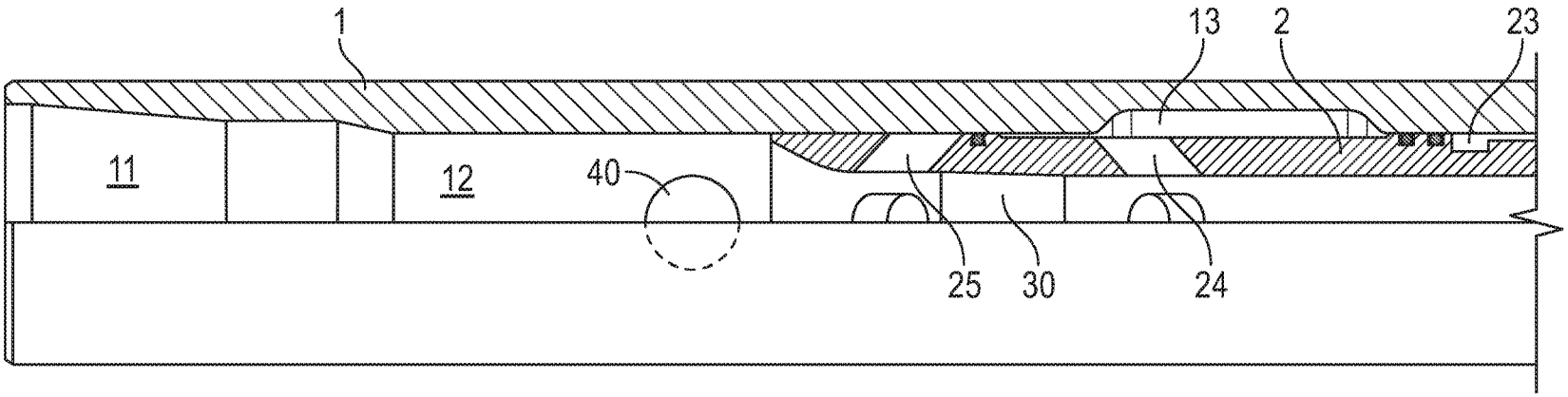
FIG. 1 is a longitudinal part-sectional view of one end of a tool mandrel forming part of a tool assembly of this disclosure.

The following disclosure provides examples for implementing embodiments of this disclosure. Specific examples of components and arrangements are provided as examples of how the disclosure can be carried out and are not intended to be limiting. Same or like reference numerals may be used to denote same or like components in different embodiments for brevity but should not be interpreted as being limiting in any way.

Referring initially to FIGS. 1-4, an embodiment of the tool assembly of the present disclosure has an elongate mandrel body 1 in the form of a mandrel adapted for attachment by a tool joint to a drill string. For example, the mandrel body 1 may be attachable to a bottom hole assembly (not shown) that may include a drill bit (not shown) at one end 10. The mandrel body 1 may be attachable to drill pipe or a tool or sub (none shown) at the other end 11.

The mandrel body 1 has an axial through bore 12 for through flow of fluids, such as drilling fluid. Within the length of the through bore 12, an inner de-coupling sleeve 2 is disposed for axial displacement therein.

The tool assembly further comprises an outer mill sleeve 50 releasably coupled to the mandrel body 1. The sleeve 50 is provided with a plurality of ribs 51 which may be axially aligned or offset at an angle to a longitudinal axis of the mandrel body 1. In this embodiment, six axially aligned ribs 51 are provided but more or fewer ribs may be used in other embodiments. Each rib 51 is profiled to provide enhanced removal of material by use of edge profiles 53, and raked surfaces 54 provided with appropriate abrasive or cutting materials 55. The abrasive material 55 may comprise tungsten carbide bonded in a suitable matrix, or the like durable abrading compositions as known in the art.

The sleeve 2 has profiled parts for performing actions, including adjusting and setting operational configurations of the tool assembly. A first configuration is a functional material-removing configuration. A second configuration is a passive non-material-removing configuration. A configuration change for the tool would be initiated by an axial displacement of the sleeve 2 in response to a fluid pressure change to be described further hereinbelow.

Figure 2:
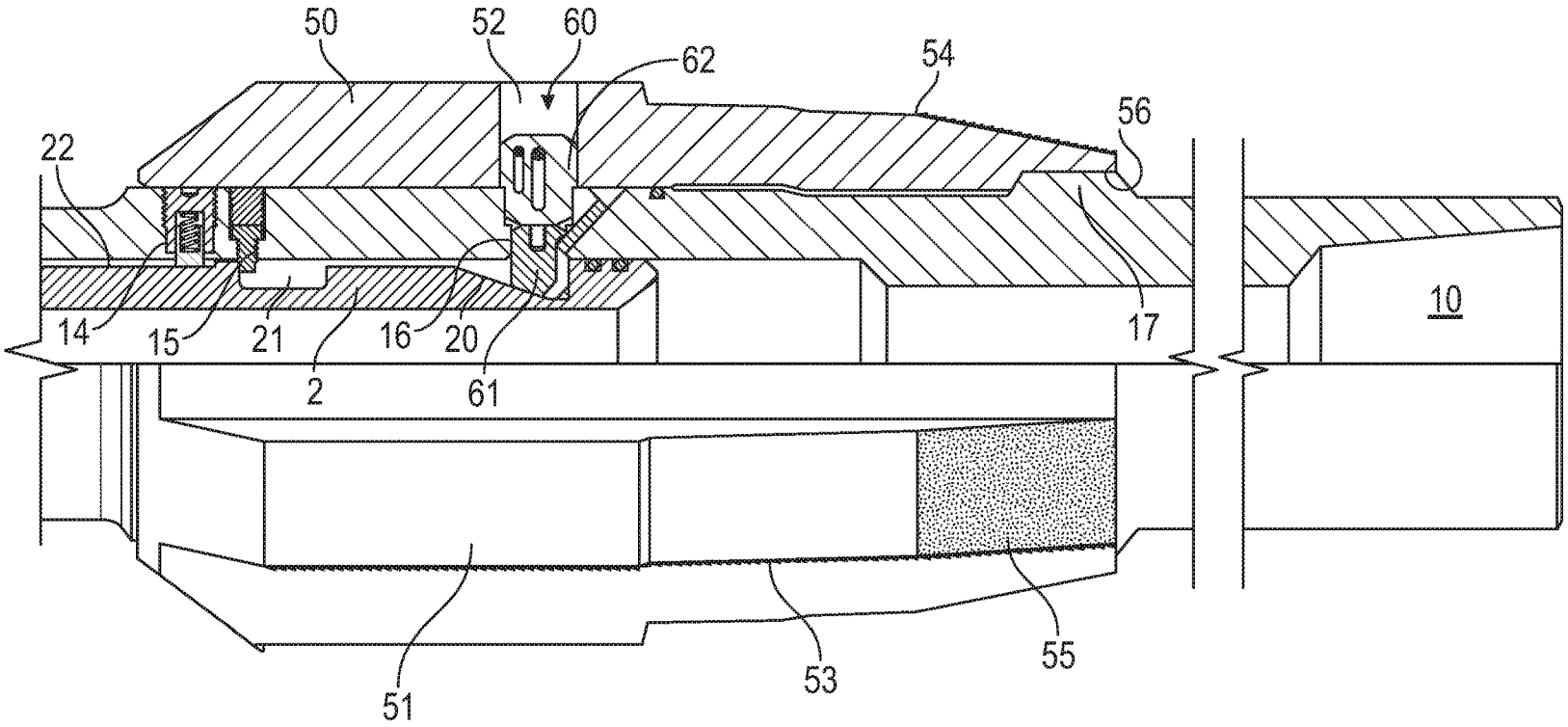
FIG. 2 is a truncated longitudinal part sectional view of another section of the tool mandrel shown in FIG. 1 and forming part of a tool assembly of this disclosure showing disengageable mill sleeve parts and a tool joint box end.

The profiled parts include a ramp 20 juxtaposed with a stepped recess 16 in the mandrel body 1. The stepped recess 16 receives a keying element 60 which in this embodiment comprises two superposed inner and outer key components indicated by reference numerals 61, 62 respectively. The keying element 60 serves as a position locking component for the first configuration of the tool assembly. In practice, one can use two such keying elements 60 disposed on opposite sides of the mandrel body 1 though only one is shown in FIG. 2.

The sleeve 2 also has a lock down socket 23 forming part of a lock down mechanism for the second configuration of the tool assembly. The socket 23 is designed to receive a portion of a compression spring-loaded pin 14 housed in the mandrel body 1 and projecting initially by a fraction of its length into an optional slot 22 in an outer surface of the sleeve 2. The slot 22 communicates as a key way or track to guide the pin 14 directly to the socket 23 during a configuration change for the tool assembly. The coupling of the mill sleeve 50 to the mandrel body 1 and its performance of a milling action are ensured by way of the keying element 60 which extends out of the stepped recess 16 in the sleeve 2 into a corresponding aperture or recess 52 in the mill sleeve 50, and by means of interlocking surface formations on the mandrel body 1 and the mill sleeve 50. The interlocking surface formations in this embodiment are corresponding splined parts 56, 17 respectively on an inner surface of the mill sleeve 50 and on an outer surface of the mandrel body 1.

The outer key component 62 may be a pin or block shape. The outer key component 62 may be located within the aperture 52. The outer key component 62 may be configured to partially penetrate the stepped recess 16, for example by provision of a diameter step change on the outer key component 62 and/or in the recess 16. The outer key component 62 is normally positioned at the outset to be only partially received into aperture 52 when the mandrel body 1 and the mill sleeve 50 are engaged, thereby providing a retaining projection bridging between the stepped recess 16 and the aperture 52. Such a configuration resists axial displacement of the mill sleeve 50 with respect to the mandrel body 1.

The superposed key components 61, 62 are inwardly and radially displaceable and are controlled by the sleeve 2. The ramp 20 of the sleeve 2 is adapted to engage an inner surface of the inner key component 61. The ramp 20 and the inner key component 61 together act as a cam and follower, with the inner key component 61 acting as a push rod upon the outer key component 62. Thus, as the sleeve 2 is moved within the mandrel body 1 a predetermined distance, the inner key component 61 is forced radially outward as the ramp 20 is displaced (to the right in FIGS. 1, 2). In this way the outer key component 62 is pushed radially outwards until clearing the recess 16, such that the boundary between the contacting surfaces of the key components 61, 62 coincides with an interface between the mandrel body 1 and the mill sleeve 50. Such outward displacement of the key components 61, 62 thereby effectively removes the retaining projection between the mill sleeve 50 and the mandrel body 1 to disengage the mill sleeve 50 from the mandrel body 1. This disengagement of the mill sleeve 50 from the mandrel body 1 permits relative translation of one away from the other. Thereby, the mill sleeve 50 is freed from the drill string and drill bit which may be run on leaving the mill sleeve 50 behind. Thus, the sleeve 2 provides a mechanism for decoupling of the mill sleeve 50 from the mandrel body 1.

Axial displacement of the sleeve 2 from a first position to a second position within the tool assembly is realized by provision of a valve seat 30 positioned towards an upstream end of the sleeve 2 and aligned within the through bore 12 to receive an obturator, such as a ball 40 delivered thereto from above the tool assembly under gravity or by circulation of drilling fluid through the tool assembly.

Shearable fasteners 15 retain the sleeve 2 in a predetermined axial position within the tool assembly during a run and prior to decoupling of the mill sleeve 50. These shearable fasteners 15 are designed to yield at a predetermined fluid pressure within the through bore 12 that can be developed upon the ball 40/valve seat 30 combination. Thus the timing of the decoupling can be determined by "dropping a ball" into the circulating drilling fluid to deliver same to the valve seat 30 and subsequently observing and controlling fluid pressure. A pressure change may be observed when the shearable fasteners 15 yield.

As can be observed from FIG. 2, the shearing of the shearable fasteners 15 allows the ramping up of the keying element 60 so that the boundary between the key components 61, 62 coincides with the interface between the mandrel body 1 and the mill sleeve 50. The positioning of the boundary between the components 61, 62 at the interface between the mandrel body 1 and the mill sleeve 50 allows the sleeve 2 to continue advancing axially in the downhole direction until the lock down pin 14 passes along the keyway or track 22 to lock in socket 23.

The valve seat 30 within the sleeve 2 may be configured as a Morse taper to capture the ball 40 for retention to obstruct fluid flow through the through bore 12. Obstructing fluid flow allows the development of sufficient fluid pressure to displace the sleeve 2 and then shear the shearable fasteners 15. This achieves the goal of releasing the mill sleeve 50 from the mandrel body 1 to allow the drill string and drill bit to be run on to continue drilling and material removal. In order to continue drilling after release of the mill sleeve 50, it may be necessary to provide for through flow of drilling fluids in the through bore 12 again. Through flow may be achieved by provision of ports 24, 25 in a side wall portion of the inner sleeve 2. The ports 24, 25 are alignable to register with an axially aligned by-pass channel 13 parallel to the through bore 12 and located in an inner side wall of the mandrel body 1. The channel 13 is sized to provide a by-pass around the ball 40 valve seat 30 obstruction to flow within a through bore of the sleeve 2. In this way, circulation of drilling fluids is restored for continuance of drilling ahead of the mill sleeve 50 position.

In use, with the aim of enabling cement to be removed from connected tubular casing sections having differing diameters, such as casing and liner, on the same drilling trip, the tool assembly described above is positioned in the hole with a suitable drilling bit or mill attached that is sized to drill out the cement in the liner, such as a 7" liner. Above the tool assembly there is provided sufficient length of drill pipe of an outside diameter (OD), such as no larger than 4.75", to match the length of the 7" liner to be drilled out. An additional casing scraper cleaning tool may be run behind the tool assembly to further enhance the cleaning of the casing above the liner.

The cement inside the casing is drilled out to form a hole, first by the drill bit or, in other embodiments, by a mill and then this hole is enlarged by the milling sleeve 50 described above. One may choose a size of the milling sleeve 50 to match the OD of the Polished Bore Receptacle (PBR) on the top of the liner.

In the first configuration of the tool assembly, the corresponding splined parts 56, 17 respectively on an inner surface of the mill sleeve 50 and on the outer surface of the mandrel body 1 engage and act to provide a mechanism to rotationally drive the mill sleeve 50. At a suitable time, for example when the tool assembly reaches the top of the liner, an object, such as a ball 40, is dropped to land and be trapped on the Morse tapered valve seat 30. Fluid pressure is increased to shear the shearable fasteners 15 at a predetermined pressure. In a non-limiting embodiment, the shearable fasteners 15 may shear or otherwise disengage from the sleeve 2. The sleeve 2 is then forced downwards which in turn pushes the inner keying component 61 outwards via the ramp 20 and in turn the inner keying component 61 pushes out the outer key component 62 to a position disengaged from the mandrel body 1. At this stage, the sleeve 2 continues to be forced downwards whereby, by virtue of the by-pass channel 13 aligned with the ports 24, 25, it is possible to re-establish fluid circulation to the drill bit. The spring-loaded lock pin 14 may extend into the socket 23 to lock the sleeve 2 in this position. The mill sleeve 50 may be "parked" on top of the liner PBR and the liner can now be drilled out on the same trip.

On completion of drilling, the mill sleeve 50 is retrievable when pulling the drill string out of the well.

Figure 3:
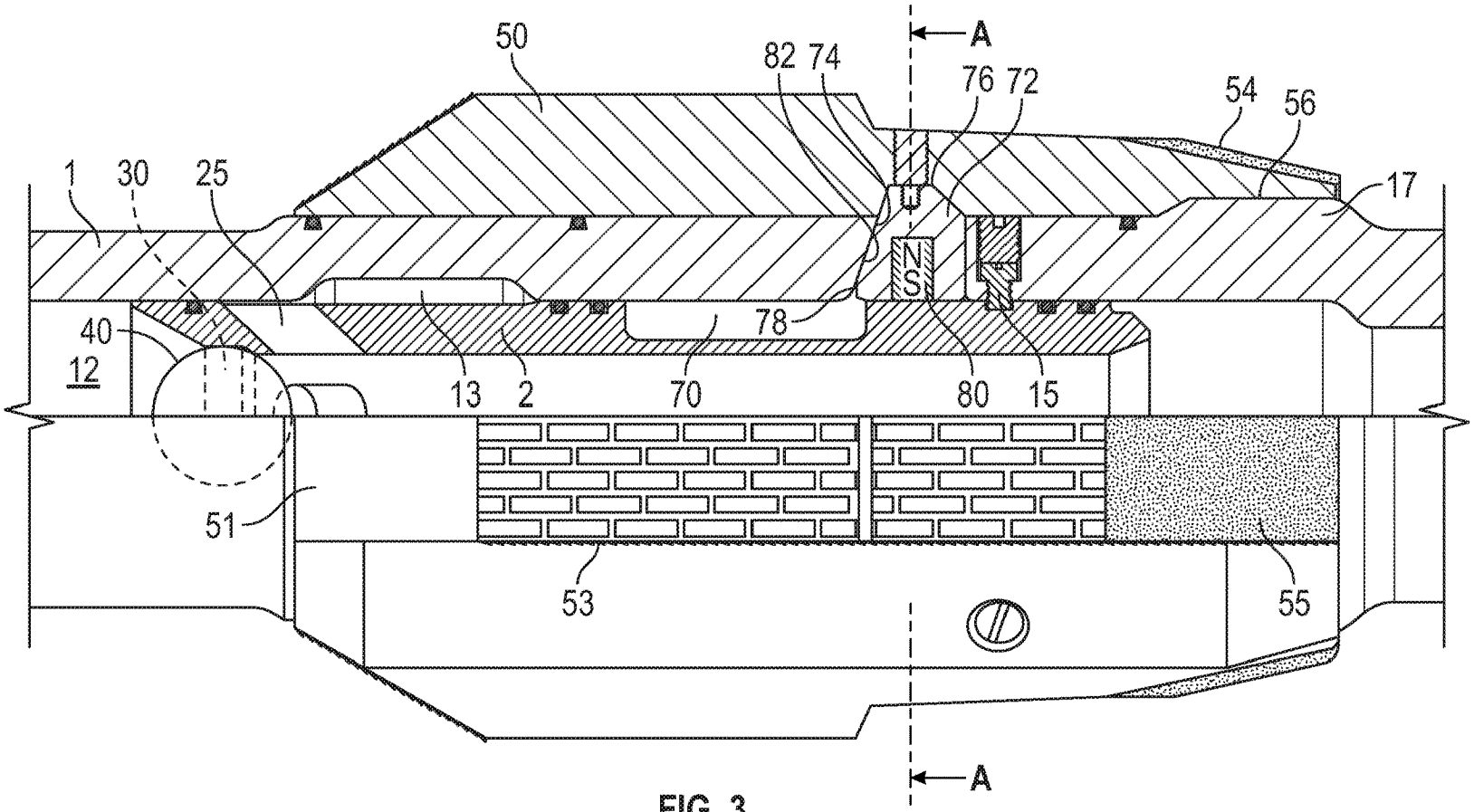
FIG. 3 is a longitudinal part-sectional view of a tool mandrel forming part of another embodiment of a tool assembly of this disclosure.
Figure 4:
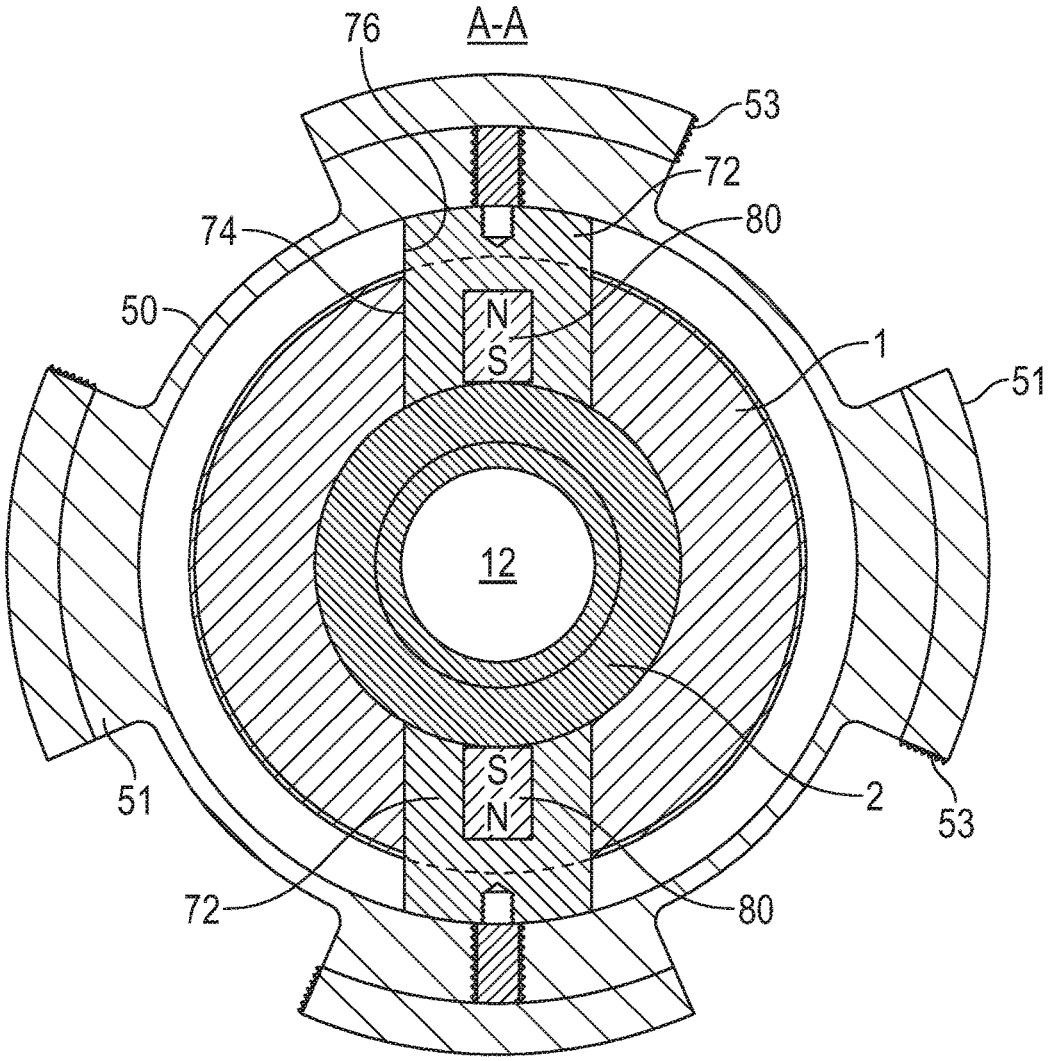
FIG. 4 is view of a cross-section of the tool mandrel of FIG. 3 in plane A-A of FIG. 3.

Referring to FIGS. 3 and 4, another embodiment of the tool assembly of the present disclosure will be described. The tool assembly of FIGS. 3 and 4 is similar to the tool assembly of FIGS. 1 and 2 in many respects and therefore, components common for the tool assembly of FIGS. 1, 2 and 3, 4 have been indicated using common reference numerals. Accordingly, only aspects of the embodiment of FIGS. 3 and 4 which are different from the embodiment of FIGS. 1 and 2 will be described below whereas aspects common between the embodiments 1, 2 and 3, 4 will not be described again, for brevity. Specifically, the difference between the embodiments of FIGS. 1, 2 and 3, 4 is in the way the outer mill sleeve 50 engages with and disengages from the mandrel body 1 in order to prevent or permit, respectively, axial displacement between the outer mill sleeve 50 and the mandrel body 1 and in the way the inner sleeve 2 is retained in position after the outer mill sleeve 50 has disengaged from the mandrel body 1.

The sleeve 2 has a cavity 70 sized for receiving a portion of a keying element 72 disposed in an aperture 74 in the mandrel body 1 when the sleeve 2 has axially moved within the mandrel body 1 as will be described below. The sleeve 2 is axially movable within the through bore 12 to change the configuration of the of the tool assembly in response to the fluid pressure change within the through bore 12. In the first configuration, the keying element 72 projects outwardly through the aperture 74 into a recess 76 in the inner surface of the outer mill sleeve 50. Thus, the keying element 72 engages both the outer mill sleeve 50 and the mandrel body 1 thereby preventing axial displacement between the outer mill sleeve 50 and the mandrel body 1. In the second configuration, the keying element 72 is displaced along the aperture 74 into the cavity 70 in the sleeve 2 when sleeve 2 has axially moved within the mandrel body 1 and the cavity 70 has aligned with the keying element 72. As a result, in the second configuration, the outer mill sleeve 50 is released from the mandrel body 1 thereby allowing relative axial displacement between the outer mill sleeve 50 and the mandrel body 1.

The keying element 72 may be provided in the form of a lock dog as shown in FIGS. 3 and 4.

The keying element 72 and the aperture 74 may have respective cooperating slanted surfaces 78, 82 so that the keying element 72 can only be received in the aperture 74 through an end of the aperture 74 facing the through bore 12. The corresponding slanted surfaces 78, 82 may render the keying element 72 receivable in the aperture 74 such that a predetermined maximum length of the keying element 72 less than the total length of the keying element 72 protrudes through an opposite open end of the aperture 74 into the recess 76 in the inner surface of the sleeve 2.

In practice, one can use two such keying elements 72 (as shown in FIG. 4) disposed on opposite sides of the mandrel body 1.

A magnet 80 is provided within the keying element 72 for retaining a portion of the keying element 72 in the cavity 70 once the sleeve 2 has axially moved within the mandrel body 1. The magnet 80 may have sufficient strength to keep the keying element 72 in the cavity 70 by keeping the keying element 72 engaged with the de-coupling sleeve 2 to prevent the keying element 72 from re-engaging with the outer mill sleeve 50. The magnet 80 may be a permanent magnet.

After the sleeve 2 has been axially displaced, a portion of the keying element 72 engages the cavity 70, while another portion of the keying element 72 remains in the aperture 74 in the mandrel body 1. Thus, the keying element 72, the cavity 70 and the magnet 80 also serve as a lock down mechanism to lock the sleeve 2 in a displaced position in the second configuration of the tool assembly.

The magnet 80 may also be used to grip and hold the keying element 72 during assembly to advance the keying element 72 along the through bore 12 and to locate the keying element 72 in the aperture 74 in the mandrel body 1.

When a ball 40, is dropped to land and be trapped on the Morse tapered valve seat 30, fluid pressure is increased to shear the shearable fasteners 15 at a pre-determined pressure. The shearing of the shearable fasteners 15 allows the sleeve 2 to be forced downwards and cause the cavity 70 to align with the keying element 72. Once the cavity 70 aligns with the keying element 72, the keying element 72 is no longer locked in place and the outer mill sleeve 50 is allowed to move axially along the mandrel body 1. As the outer mill sleeve 50 is pushed axially along the mandrel body by reaction forces the slanted surfaces 78, 82 cooperate with the result that the outer mill sleeve 50 displaces the keying element 72 inwardly into the cavity 70. This effectively removes the retaining projection of the keying element 72 between the mill sleeve 50 and the mandrel body 1 to disengage the mill sleeve 50 completely from the mandrel body 1. This disengagement of the mill sleeve 50 from the mandrel body 1 permits relative translation of one away from the other. The keying element 72 thus frees the outer mill sleeve 50 from the mandrel body 1 and at the same time locks the sleeve 2 in the second configuration to prevent the sleeve 2 from traveling back into its original position in which fluid passage in the through bore 12 is blocked by the ball 40 and fluid pressure builds up. Once the sleeve 2 has moved so that the keying element 72 is received in the cavity 70, the by-pass channel 13 is aligned with the port 25 to re-establish fluid circulation to the drill bit. Thereby, the mill sleeve 50 is freed from the drill string and drill bit which may continue to be advanced down hole leaving the mill sleeve 50 behind.

A material-removing tool in accordance with the present disclosure can be coupled to a drill bit and releasably mounted on a drill string and remotely operable to provide at least two configurations. A first configuration is a functional material-removing configuration. A second configuration is a passive non-material-removing configuration.

The material-removing tool may be a milling tool adapted to remove material, such as cement solids from a cased wellbore. Such a milling tool may comprise a mill sleeve having an exterior surface configuration comprising a plurality of ribs, for example from about three to about six ribs. Each such rib may have at least one leading angled profile surface dressed with an abrasive material for contacting and abrading cementitious material surfaces or plugs. A suitable abrasive material may be one such as a particulate silicon or metal carbide in a suitable matrix, and may comprise tungsten carbide particles. An inner surface of the mill sleeve may have a portion configured to engage with a corresponding outer portion of an elongate body whereby the mill sleeve may be rotated about the longitudinal axis of the tool whenever the drill string is turned. In a suitable embodiment, corresponding portions of the inner surface of the mill sleeve and an outer surface of the elongate body are splined, for example provided with cooperating ridges or teeth which, when engaged, lock the mill sleeve and elongate body together for rotation. However, upon relative axial displacement of the elongate body with respect to the mill sleeve, when preparing for drilling ahead by advancing the drill string, the mill sleeve is released from rotational motion of the drill string. In a typical scenario of use, the released mill sleeve at that stage is deposited at the polished bore receptacle (PBR) whilst the drill string is advanced to drill ahead and continue removal of cementitious materials from the liner. The PBR may be positioned at the top of a liner associated with a liner hanger disposed in a cased wellbore.

In embodiments, the milling tool may also be configured for example by extension thereof to present cleaning element surfaces to the PBR so as to accomplish clean out of the inside diameter of the PBR before it is released from the drill string.

The material-removing tool may be de-coupled or disengaged from the drill bit and drill string at a selected location in the wellbore. The material-removing tool or a separately decoupled part thereof can be adapted for retrieval so that it may be recovered when the drill string is withdrawn from the wellbore.

After the desired material-removal task has been completed by the material-removing tool, the elements can be de-coupled from the drill bit and drill string, allowing the drill bit and drill string to be advanced in down the wellbore ahead of the de-coupled elements.

According to an aspect of the disclosure, a milling tool assembly suitable for use as a material-removing tool comprises:

an elongate body having each end thereof (uphole and downhole ends) adapted for forming a tool joint, the body having an axial through bore and having at least one aperture in a side wall of the elongate body for receiving a keying element; an inner de-coupling sleeve axially movable within the through bore of the elongate body to control a configuration of the milling tool assembly, an outer mill sleeve disposed upon the elongate body and having a recess in an inner surface for engaging with the keying element, the keying element being movably arranged in relation to the elongate body and the outer mill sleeve to be displaced when the de-coupling sleeve is axially moved within the elongate body;

wherein in a first configuration the keying element engages the outer mill sleeve and the elongate body thereby preventing axial displacement between the outer mill sleeve and elongate body; and in a second configuration the keying element is displaced in the aperture whereby the outer mill sleeve is released from the elongate body thereby allowing relative axial displacement between the outer mill sleeve and the elongate body.

The keying element which serves as a position locking component for a configuration of the milling tool assembly may take a number of forms.

In an embodiment, the de-coupling sleeve has an inclined surface for displacing the keying element outwardly through the aperture in the elongate body when the de-coupling sleeve is axially moved within the elongate body; and wherein the keying element is separable upon outward displacement at a boundary coincident with the interface between the outer mill sleeve and the elongate body thereby allowing relative axial displacement between the outer mill sleeve and the elongate body.

In one suitable form the keying element comprises superposed inner and outer confronting components respectively which may be pinned to the elongate body and mill sleeve, for example, by using self-locking shearable pins, such as Bissell pins, such that the boundary between the separable inner and outer components lies within the aperture in the elongate body before axial displacement of the separable inner and outer components in the aperture.

In an embodiment, the de-coupling sleeve has a cavity sized for receiving a portion of the keying element and a bias arrangement for displacing the keying element inwardly through the aperture in the elongate body into the cavity when the de-coupling sleeve is axially moved within the elongate body; and wherein the keying element is disengaged from the outer mill sleeve upon inward displacement thereby allowing relative axial displacement between the outer mill sleeve and the elongate body. The bias arrangement may comprise cooperating wedge portions on the keying element and the outer mill sleeve, the wedge portions being mutually arranged so that the keying element is pushed into the cavity by the wedge portion of the outer mill sleeve once the de-coupling sleeve has axially moved within the elongate body so that the cavity is in register with the keying element. The wedge portions may comprise cooperating faces on the keying element and the outer mill sleeve. The cooperating faces may be slanted at an angle to a longitudinal axis of the elongate body, such as, for example, 45°.

A retaining arrangement may be provided to retain the keying element in the cavity upon disengagement of the keying element from the outer mill sleeve upon inward displacement in the aperture. The retaining arrangement may comprise a magnet arranged to retain the keying element in the cavity once the de-coupling sleeve has axially moved within the elongate body. The magnet may have sufficient strength to retain the keying element in the cavity by keeping the keying element engaged with the de-coupling sleeve. The magnet may be a permanent magnet. The magnet may be provided on and/or in the keying element. The magnet may be usable as a gripping aid when locating the keying element in the aperture in the elongate body.

The bias arrangement may comprise a combination of bias arrangements.

The keying element and the aperture may be mutually configured, for example by providing the keying element and the aperture with cooperating slanted surfaces, to render the keying element receivable in the aperture such that a maximum length by which the keying element can protrude through an opposite open end of the aperture into the recess in the inner surface of the outer mill sleeve is a predetermined length less than the total length of the keying element. The keying element and the aperture may be mutually configured to render the keying element receivable in the aperture through only one open end of the aperture. The keying element may be receivable in the aperture through an end of the aperture facing the through bore of the elongate component. In an embodiment, the cooperating slanted surfaces may be provided by the wedge portions of the bias arrangement.

The keying element may comprise a lock dog.

In embodiments, the inner de-coupling sleeve has fluid by-pass ports in a side wall portion which ports are alignable in the second configuration of the milling tool assembly with an axial by-pass channel parallel to the through bore and located in an inner side wall of the elongate body. The by-pass channel is sized to provide a by-pass around a valve seat formed in the inner de-coupling sleeve across the through bore, the valve seat being configured to receive an obturator to block flow through the valve seat for purposes of displacing the inner de-coupling sleeve.

The inner de-coupling sleeve may be held in the first configuration by retainers. The retainers may be shearable pins.

The de-coupling sleeve may be activated by a fluid pressure change event sufficient to cause the retainers holding the decoupling sleeve in the first configuration to yield, for example, by shearing, or otherwise release the inner de-coupling sleeve for axial displacement. The fluid pressure change may be effected by the configuration of the de-coupling sleeve for axial displacement and provision in the de-coupling sleeve of a valve seat adapted to capture an obturator, which may be a ball. The obturator may be delivered to the valve seat from above the material-removing tool through a drill string under gravity or pumped down in the circulating drilling fluid to plug flow through the material-removing tool. In embodiments, the obturator is captured upon the valve seat and retained there. The valve seat may be of the Morse taper type whereby the obturator is captured by friction between the obturator and the valve seat.

The displacement of the de-coupling sleeve brings the fluid flow by-pass ports in the decoupling sleeve into registry with the fluid flow by-pass channel formed in the elongate body so that fluid circulation through the through bore of the material-removing tool and the drill string to a bottom hole assembly can be resumed.

A lock down mechanism may be provided to lock the de-coupling sleeve in a displaced position in the second configuration.

In an embodiment, the lock down mechanism may comprise a compression spring-loaded pin located in the elongate body and releasable into engagement with a socket in the de-coupling sleeve as the de-coupling sleeve is axially displaced. By such means the de-coupling sleeve is locked down in the second configuration to ensure that fluid flow through the milling tool assembly via the valve seat by-pass ports and by-pass channel is secured.

In the embodiment, in which the de-coupling sleeve has a cavity sized for receiving a portion of the keying element and a bias arrangement for displacing the keying element inwardly through the aperture in the elongate body into the cavity when the de-coupling sleeve is axially moved within the elongate body, the keying element, the cavity and the bias arrangement may provide the lock down mechanism. After the de-coupling sleeve has been axially displaced, a portion of the keying element engages the cavity, while another portion of the keying element remains in the aperture in the elongate body. Thus, the keying element, the cavity and the bias arrangement serve as a lock down mechanism to lock the de-coupling sleeve in a displaced position in the second configuration of the tool assembly.

A drill bit which is sized to transit through the tubular casing sections having differing through bore widths, and to remove material from at least the narrowest of the tubular sections, may be selectively operated before use of the milling tool assembly, in conjunction with the milling tool assembly on occasion, and after de-coupling of the mill sleeve to remove additional material from the cased wellbore so as to achieve the aim of continuing material removal in a narrower bore casing or liner, or to extend the borehole, ahead of the milling tool assembly.

When drilling is completed, and the drill string is retrieved, i.e. on pull out of the wellbore, the elongate body re-engages with the mill sleeve and in this way the previously disengaged mill sleeve is retrievable.

In another aspect, the disclosure provides a method of operating a milling tool assembly used as a material-removing tool, the method comprising the steps of:

providing an elongate body having each end thereof (uphole and downhole ends) adapted for forming a tool joint, the body having an axial through bore and having at least one aperture in a side wall of the elongate body for receiving a keying element; an inner de-coupling sleeve axially movable within the through bore of the elongate body to control a configuration of the milling tool assembly; an outer mill sleeve disposed upon the elongate body and having a recess in an inner surface for engaging with the keying element, the keying element being movably arranged in relation to the elongate body and the outer mill sleeve to be displaced when the de-coupling sleeve is axially moved within the elongate body; wherein in a first configuration the keying element engages the outer mill sleeve and the elongate body thereby preventing axial displacement between the outer mill sleeve and elongate body; and in a second configuration the keying element is displaced in the aperture whereby the outer mill sleeve is released from the elongate body thereby allowing relative axial displacement between the outer mill sleeve and the elongate body;

moving the de-coupling sleeve axially within the elongate body into the second configuration;

displacing the keying element in the aperture thereby releasing the outer mill sleeve from the elongate body and allowing relative axial displacement between the outer mill sleeve and the elongate body; and disengaging the outer mill sleeve from the elongate body.

The method may further comprise the step of providing a tool assembly for removal of material such as cement from connected tubulars of differing bore size, such as casing and liner, comprising a drill bit connectable with drill pipe forming part of a drill string and coupling the milling tool assembly to the drill bit and the drill string.

The method may further comprise the step of running the drill string and the drill bit in a well bore while operating the drill bit; when required, operating the milling tool assembly and subsequently disengaging the outer mill sleeve from the elongate body; and continuing drilling upon disengaging the outer mill sleeve from the elongate body.

The method may further comprise the step of providing the de-coupling sleeve with an inclined surface; using the inclined surface to displace the keying element outwardly through the aperture in the elongate body when the de-coupling sleeve is axially moved within the elongate body; and separating the keying element upon outward displacement at a boundary coincident with the interface between the outer mill sleeve and the elongate body thereby allowing relative axial displacement between the outer mill sleeve and the elongate body.

The method may further comprise the step of providing the keying element with superposed inner and outer confronting components and positioning the confronting components in the aperture such that the boundary between the separable inner and outer components lies within the aperture in the elongate body before axial displacement of the separable inner and outer components in the aperture.

The method may further comprise the step of providing the de-coupling sleeve with a cavity sized for receiving a portion of the keying element and displacing, using a bias arrangement, the keying element inwardly through the aperture in the elongate body into the cavity when the de-coupling sleeve is axially moved within the elongate body;

and disengaging the keying element from the outer mill sleeve upon inward displacement thereby allowing relative axial displacement between the outer mill sleeve and the elongate body. The method may comprise the step of providing the bias arrangement with cooperating wedge portions on the keying element and the outer mill sleeve and pushing the keying element into the cavity by means of the wedge portion of the outer mill sleeve once the de-coupling sleeve has axially moved within the elongate body so that the cavity is in register with the keying element. The method may comprise the step of providing the wedge portions with cooperating faces on the keying element and the outer mill sleeve and using the cooperating faces to move the keying element. The cooperating faces may be slanted at an angle to a longitudinal axis of the elongate body, such as, for example, 45°.

The method may further comprise the step of retaining the keying element in the cavity by means of a retaining arrangement upon disengagement of the keying element from the outer mill sleeve upon inward displacement of the keying element in the aperture.

The method may further comprise the step of providing the retaining arrangement with a magnet and retaining the keying element in the cavity by the magnet once the de-coupling sleeve has been axially moved within the elongate body. The method may further comprise the step of using the magnet to keep the keying element engaged with the milled-coupling sleeve in the cavity. The method may further comprise the step of using the magnet as a gripping aid when locating the keying element in the aperture in the elongate body.

The method may further comprise the step of placing the keying element in the aperture such that the keying element protrudes through an opposite open end of the aperture into the recess in the inner surface of the outer mill sleeve by a predetermined length less than the total length of the keying element. The method may further comprise the step of placing keying element in the aperture through an end of the aperture facing the through bore of the elongate component.

The method may further comprise the step of providing the inner de-coupling sleeve with by-pass ports in a side wall portion and aligning the ports in the second configuration of the milling tool assembly with an axial by-pass channel parallel to the through bore and located in an inner side wall of the elongate body thereby providing a by-pass around a valve seat formed in the inner de-coupling sleeve across the through bore, the valve seat being configured to receive an obturator to block flow through the valve seat for purposes of displacing the inner de-coupling sleeve.

The method may further comprise the step of holding the inner de-coupling sleeve in the first configuration by retainers, such as, for example, shearable pins.

The method may further comprise the step of activating the de-coupling sleeve by a fluid pressure change event sufficient to cause the retainers holding the decoupling sleeve in the first configuration to yield, for example, by shearing, or otherwise release the inner de-coupling sleeve for axial displacement. The method may further comprise the step of effecting the fluid pressure change by delivering an obturator, which may be a ball, to a valve seat provided across the through bore of the elongate body from above the material-removing tool under gravity or by pumping down in the circulating drilling fluid to plug flow through the material-removing tool. The method may further comprise the step of capturing and retaining the obturator upon the valve seat. The valve seat may be of the Morse taper type whereby the method may further comprise the step of capturing the obturator by friction between the obturator and the valve seat.

The method may further comprise the step of, upon displacing the de-coupling sleeve, bringing the fluid flow by-pass ports in the decoupling sleeve into registry with the fluid flow by-pass channel formed in the elongate body and resuming fluid circulation through the through bore of the material-removing tool and the drill string to the bottom hole assembly.

The method may further comprise the step of locking the de-coupling sleeve in a displaced position in the second configuration.

The method may further comprise the step of providing a compression spring-loaded pin in the elongate body and releasing the spring into engagement with a socket in the de-coupling sleeve as the de-coupling sleeve is axially displaced thereby locking the de-coupling sleeve in the second configuration to ensure that fluid flow through the milling tool assembly via the valve seat by-pass ports and by-pass channel is secured.

In the embodiment, in which the de-coupling sleeve has a cavity sized for receiving a portion of the keying element and a bias arrangement for displacing the keying element inwardly through the aperture in the elongate body into the cavity when the de-coupling sleeve is axially moved within the elongate body, the method may comprise the step of using the keying element, the cavity and the bias arrangement to lock the de-coupling sleeve in a displaced position in the second configuration. The method may further comprise the step of, after the de-coupling sleeve has been axially displaced, causing a portion of the keying element to engage the cavity and causing another portion of the keying element to remain in the aperture in the elongate body to lock the de-coupling sleeve in a displaced position in the second configuration of the tool assembly.

The method may further comprise the step of selectively operating the drill bit which is sized to transit through the tubular casing sections having differing through bore widths, and to remove material from at least the narrowest of the tubular sections, before use of the milling tool assembly, in conjunction with the milling tool assembly on occasion, and after de-coupling of the mill sleeve to remove additional material from the cased wellbore for continuous material removal in a narrower bore casing or liner, or to extend the borehole, ahead of the milling tool assembly.

The method may further comprise the step of re-engaging the elongate body with the mill sleeve and retrieving the previously disengaged mill sleeve during retrieval of the drill string.

A tool assembly for removal of material such as cement from connected tubulars of differing bore size, such as casing and liner, comprises a drill bit connectable with drill pipe forming part of a drill string, and a milling tool assembly comprising

- an elongate body having each end thereof (uphole and downhole ends) adapted for forming a tool joint, the body having an axial through bore and having at least one aperture in a side wall of the elongate body for receiving a keying element;
- an inner de-coupling sleeve axially movable within the through bore of the elongate body to control a configuration of the milling tool assembly,
- an outer mill sleeve disposed upon the elongate body and having a recess in an inner surface for engaging with the keying element, the keying element being movably arranged in relation to the elongate body and the outer mill sleeve to be displaced when the de-coupling sleeve is axially moved within the elongate body;

wherein in a first configuration the keying element engages the outer mill sleeve and the elongate body thereby preventing axial displacement between the outer mill sleeve and elongate body; and in a second configuration the keying element is displaced in the aperture whereby the outer mill sleeve is released from the elongate body thereby allowing relative axial displacement between the outer mill sleeve and the elongate body.

The milling tool assembly may be in accordance with the aspect of disclosure as described above.

In embodiments, the drill bit may be coupled directly to the milling tool assembly.

In other embodiments, the milling tool assembly may be spaced apart from the drill bit by a sub or section of drill pipe.

The tool assembly may additionally comprise at least one casing scraping clean up tool spaced out from the milling tool assembly. The at least one casing scraping clean up tool may be integratedly attached above the milling tool assembly. A suitable casing scraping clean up tool may comprise a non-rotating self-centralizing, flexible-bladed lantern mounted upon a high strength, one-piece main mandrel which rotates through stabilizer sleeves and the lantern to avoid damage to casing during drill string rotation, with abrasive compound covered fixed-mill rings mounted to the mandrel by a suitable attachment or locking means. Commercial examples include without limitation RAZOR BACK® from Specialised Petroleum Services Group Limited, c.f. patents U.S. Pat. No. 6,530,429 & U.S. Pat. No. 7,096,950, hereby incorporated by reference. Other suitable scraping clean up tools may comprise conventional block-type rotating scraping tools. The casing scraping clean up tool may have abrasive compound covered fixed-mill rings mounted to the mandrel by locking screws.

Various modifications may be made to the disclosure described hereinbefore without departing from the scope thereof.

The invention claimed is:

1. A tool assembly comprising:

an elongate body having uphole and downhole ends adapted for forming a tool joint, the body having an axial through bore and having at least one aperture in a side wall of the elongate body for receiving a keying element, wherein the at least one aperture extends through the side wall of the elongate body from an inner surface adjacent to the bore to an outer surface opposite with respect to the inner surface of the elongate body;

an inner de-coupling sleeve axially movable within the through bore of the elongate body to control a configuration of the tool assembly, the tool assembly being movable from a first configuration to a second configuration;

an outer mill sleeve disposed upon the elongate body and having a recess in an inner surface for engaging with the keying element; and the keying element being movably arranged in relation to the elongate body and the outer mill sleeve to be displaced when the de-coupling sleeve is axially moved within the elongate body, wherein the keying element comprises superposed inner and outer confronting components separable at a separation boundary between the superposed inner and outer confronting components such that the separation boundary is positioned in the at least one aperture of the elongate body before axial movement of the de-coupling sleeve within the elongate body, wherein, in the first configuration, the keying element engages the outer mill sleeve and the elongate body thereby preventing axial displacement between the outer mill sleeve and elongate body and, in the second configuration, the keying element is displaced in the at least one aperture in the elongate body whereby the outer mill sleeve is released from the elongate body thereby allowing relative axial displacement between the outer mill sleeve and the elongate body, and further wherein the inner de-coupling sleeve has an inclined surface adapted to displace the keying element outwardly through the aperture in the elongate body when the inner de-coupling sleeve is axially moved within the elongate body.

2. The tool assembly of claim 1, wherein the de-coupling sleeve has a cavity sized for receiving a portion of the keying element and a bias arrangement for displacing the keying element inwardly through the aperture in the elongate body into the cavity when the de-coupling sleeve is axially moved within the elongate body and wherein the keying element is disengaged from the outer mill sleeve upon inward displacement thereby allowing relative axial displacement between the outer mill sleeve and the elongate body.

3. The tool assembly of claim 2, wherein the bias arrangement comprises cooperating wedge portions on the keying element and the outer mill sleeve, the wedge portions being mutually arranged so that the keying element is pushed into the cavity by the wedge portion of the outer mill sleeve once the de-coupling sleeve has axially moved within the elongate body so that the cavity is in register with the keying element.

4. The tool assembly of claim 3, wherein the wedge portions comprise cooperating faces on the keying element and the outer mill sleeve, the cooperating faces being slanted at an angle to a longitudinal axis of the elongate body.

5. The tool assembly of claim 2, wherein a retaining arrangement is provided to retain the keying element in the cavity upon disengagement of the keying element from the outer mill sleeve upon inward displacement in the aperture.

6. The tool assembly of claim 5, wherein the retaining arrangement comprises a magnet arranged to retain the keying element in the cavity once the de-coupling sleeve has axially moved within the elongate body, the magnet having sufficient strength to retain the keying element in the cavity by keeping the keying element engaged with the de-coupling sleeve.

7. The tool assembly of claim 6, wherein the magnet is provided on and/or in the keying element.

8. The tool assembly of claim 1, wherein the keying element is separable upon outward displacement at the separation boundary coincident with the interface between the outer mill sleeve and the elongate body thereby allowing relative axial displacement between the outer mill sleeve and the elongate body.

9. The tool assembly of claim 8, wherein the separation boundary between the separable and superposed inner and outer components lies within the aperture in the elongate body before axial displacement of the separable and superposed inner and outer components in the aperture.

10. The tool assembly of claim 1, wherein the inner de-coupling sleeve has fluid by-pass ports in a side wall portion the ports being alignable in the second configuration of the milling tool assembly with an axial by-pass channel parallel to the through bore and located in an inner side wall of the elongate body, the by-pass channel being sized to provide a by-pass around a valve seat formed in the inner de-coupling sleeve across the through bore, the valve seat being configured to receive an obturator to block flow through the valve seat for purposes of displacing the inner de-coupling sleeve, wherein the displacement of the de-coupling sleeve brings the fluid flow by-pass ports in the decoupling sleeve into registry with the fluid flow by-pass channel formed in the elongate body so that fluid circulation through the through bore of a material-removing tool and a drill string to a bottom hole assembly can be resumed.

11. The tool assembly of claim 10, wherein the inner de-coupling sleeve is held in the first configuration by retainers and wherein the de-coupling sleeve is activatable by a fluid pressure change event sufficient to cause the retainers holding the decoupling sleeve in the first configuration to yield to release the inner de-coupling sleeve for axial displacement, wherein the fluid pressure change is effected by the configuration of the de-coupling sleeve for axial displacement and provision in the de-coupling sleeve of a valve seat adapted to capture the obturator, delivered to the valve seat from above the material-removing tool through a drill string under gravity or pumped down in the circulating drilling fluid to plug flow through the material-removing tool.

12. The tool assembly of claim 1, wherein a lock down mechanism is provided to lock the de-coupling sleeve in a displaced position in the second configuration.

13. A method comprising:

providing a tool assembly comprising:

an elongate body having uphole and downhole ends adapted for forming a tool joint, the body having an axial through bore and having at least one aperture formed in, and extending through, a side wall of the elongate body for receiving a keying element;

an inner de-coupling sleeve axially movable within the through bore of the elongate body to control a configuration of the tool assembly, the inner de-coupling sleeve having a total length defined between an uphole end and a downhole end located opposite with respect to the uphole end, the tool assembly being movable from a first configuration to a second configuration; and an outer mill sleeve disposed upon the elongate body and having a recess in an inner surface for engaging with the keying element, the keying element being movably arranged in relation to the elongate body and the outer mill sleeve to be displaced when the de-coupling sleeve is axially moved within the elongate body;

wherein, in the first configuration, the keying element engages the outer mill sleeve and the elongate body thereby preventing axial displacement between the outer mill sleeve and elongate body and, in the second configuration, the keying element is displaced in the aperture whereby the outer mill sleeve is released from the elongate body thereby allowing relative axial displacement between the outer mill sleeve and the elongate body;

moving the de-coupling sleeve axially within the elongate body into the second configuration in response to a fluid pressure change provided at an intermediate position along the length of the de-coupling sleeve between the uphole end and the downhole end of the de-coupling sleeve;

displacing the keying element in the at least one aperture in the elongate body;

separating the keying element into components at a separation boundary between the components of the keying element thereby releasing the outer mill sleeve from the elongate body and allowing relative axial displacement between the outer mill sleeve and the elongate body, wherein the separation boundary between the components of the keying element lies within the at least one aperture in the elongate body before displacement of the keying element in the at least one aperture; and disengaging the outer mill sleeve from the elongate body.

14. The method of claim 13, further comprising:

providing a tool assembly for removal of material from connected tubulars of differing bore size, the tool assembly comprising a drill bit connectable with drill pipe forming part of a drill string and coupling the milling tool assembly to the drill bit and the drill string;

running the drill string and the drill bit in a well bore while operating the drill bit; when required, operating the milling tool assembly and subsequently disengaging the outer mill sleeve from the elongate body; and continuing drilling upon disengaging the outer mill sleeve from the elongate body.

15. The method of claim 14, further comprising:

re-engaging the elongate body with the mill sleeve and retrieving the previously disengaged mill sleeve during retrieval of the drill string.

16. The method of claim 13, further comprising:

providing the inner de-coupling sleeve with by-pass ports in a side wall portion and aligning the ports in the second configuration of the tool assembly with an axial by-pass channel parallel to the through bore and located in an inner side wall of the elongate body thereby providing a by-pass around a valve seat formed in the inner de-coupling sleeve across the through bore, the valve seat being configured to receive an obturator to block flow through the valve seat for purposes of displacing the inner de-coupling sleeve;

upon displacing the de-coupling sleeve, bringing the fluid flow by-pass ports in the decoupling sleeve into registry with the fluid flow by-pass channel formed in the elongate body and resuming fluid circulation through the through bore of the material-removing tool and the drill string to the bottom hole assembly.

17. The method of claim 13, further comprising:

holding the inner de-coupling sleeve in the first configuration by retainers;

activating the de-coupling sleeve by a fluid pressure change event sufficient to cause the retainers holding the decoupling sleeve in the first configuration to yield to release the inner de-coupling sleeve for axial displacement;

effecting fluid pressure change by delivering an obturator to a valve seat provided across the through bore of the elongate body from above the material-removing tool under gravity or by pumping down in the circulating drilling fluid to plug flow through the material-removing tool;

capturing and retaining the obturator upon the valve seat; and locking the de-coupling sleeve in a displaced position in the second configuration.

18. A tool assembly comprising:

a drill bit connectable with drill pipe forming part of a drill string, and a milling tool assembly comprising:

an elongate body having uphole and downhole ends adapted for forming a tool joint, the body having an axial through bore and having at least one aperture formed in, and extending through, a side wall of the elongate body for receiving a keying element;

an inner de-coupling sleeve axially movable within the through bore of the elongate body to control a configuration of the milling tool assembly, the milling tool assembly being movable from a first configuration to a second configuration;

an outer mill sleeve disposed upon the elongate body and having a recess in an inner surface for engaging with the keying element;

the keying element being movably arranged in relation to the elongate body and the outer mill sleeve to be displaced when the de-coupling sleeve is axially moved within the elongate body;

wherein, in the first configuration, the keying element engages the outer mill sleeve and the elongate body thereby preventing axial displacement between the outer mill sleeve and elongate body and interlocking surface formations on the elongate body and the outer mill sleeve couple the outer mill sleeve to the elongate body and, in the second configuration, the keying element is displaced in the aperture in the elongate body and separable into inner and outer components at a separation boundary between the inner and outer components whereby the outer mill sleeve is released from the elongate body thereby allowing relative axial displacement between the outer mill sleeve and the elongate body and the inner de-coupling sleeve is axially movable within the elongate body in response to a fluid pressure change provided at or near a valve seat of the inner de-coupling sleeve positioned intermediately between uphole and downhole ends of the inner de-coupling sleeve, wherein the separation boundary between the inner and outer components of the keying element lies within the aperture in the elongate body before displacement of the keying element in the aperture of the elongate body.

19. The tool assembly of claim 18, wherein the interlocking surface formations on the elongate body and the outer mill sleeve are splined parts on an inner surface of the outer mill sleeve and on an outer surface of the elongate body.

* * * * *